US007551021B2

(12) United States Patent
Florescu

(10) Patent No.: US 7,551,021 B2
(45) Date of Patent: Jun. 23, 2009

(54) LOW-LEAKAGE CURRENT SOURCES AND ACTIVE CIRCUITS

(75) Inventor: Octavian Florescu, Kanata (CA)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 11/165,269

(22) Filed: Jun. 22, 2005

(65) Prior Publication Data

US 2006/0290416 A1 Dec. 28, 2006

(51) Int. Cl.
*G05F 1/10* (2006.01)

(52) U.S. Cl. ..... 327/543

(58) Field of Classification Search ..... 323/315; 327/534, 535, 537, 538, 543, 143
See application file for complete search history.

(56) References Cited

U.S. PATENT DOCUMENTS 4,697,097 A * 9/1987 Rusznyak ..... 327/546
4,929,884 A 5/1990 Bird et al.
4,970,408 A * 11/1990 Hanke et al. ..... 327/143
5,353,347 A 10/1994 Irissou et al.
5,473,283 A 12/1995 Luich
5,508,643 A * 4/1996 Khieu ..... 327/51
5,568,084 A * 10/1996 McClure et al. ..... 327/538
5,602,502 A * 2/1997 Jiang ..... 327/143
5,825,220 A * 10/1998 Kinugasa et al. ..... 327/143
6,052,006 A * 4/2000 Talaga et al. ..... 327/143
6,194,955 B1 * 2/2001 Ishida ..... 327/538
6,246,555 B1 6/2001 Tham
6,861,832 B2 3/2005 Perez
6,882,224 B1 * 4/2005 Gaboury et al. ..... 330/253
6,882,836 B2 4/2005 Wilcox
6,894,473 B1 * 5/2005 Le et al. ..... 323/314

OTHER PUBLICATIONS

Baderna D et al: "A 1.2 V Sense Amplifier for High-Performance Embeddable MOR Flash Memories" Circuits and Systems, 2005. ISCAS 2005 IEEE International Symposium on Kobe, Japan May 23-26, 2005, Piscataway, NJ, USA IEEE May 23, 2005 pp. 1266-1269, XP010815941.

(Continued)

*Primary Examiner*—Jeffrey S Zweizig
(74) *Attorney, Agent, or Firm*—Jiayu Xu

(57) ABSTRACT

A low-leakage circuit includes first, second, and third transistors, which may be P-channel or N-channel FETs. The first transistor provides an output current when enabled and presents low leakage current when disabled. The second transistor enables or disables the first transistor. The third transistor connects or isolates the first transistor to/from a predetermined voltage (e.g., $V_{DD}$ or $V_{SS}$). The circuit may further include a pass transistor that provides a reference voltage to the source of the first transistor when the first transistor is disabled. In an ON state, the first transistor provides the output current, and the second and third transistors do not impact performance. In an OFF state, the second and third transistors are used to provide appropriate voltages to the first transistor to place it in a low-leakage state. The first, second, and third transistors may be used for a low-leakage current source within a current mirror, an amplifier stage, and so on.

14 Claims, 8 Drawing Sheets

OTHER PUBLICATIONS

Sambandan S et al: "Analogue circuit building blocks with amorphous silicon thin film transisstors" Electronics Letters, IEEE Stevenage, GB, vol. 41, No. 6, Mar. 17, 2005, pp. 314-315, XP006023635.

International Search Report - PCT/US06/024503, International Search Authority - European Patent Office, - Nov. 5, 2007.

International Preliminary Report on Patentability - PCT/US06/024503, International Search Authority - European Patent Office - Dec. 24, 2007.

Written Opinion of the International Searching Authority - PCT/US06/024503, European Patent Office - Dec. 22, 2007.

* cited by examiner

Prior Art

LOW-LEAKAGE CURRENT SOURCES AND ACTIVE CIRCUITS

BACKGROUND

I. Field

The present invention relates generally to electronics circuits, and more specifically to current sources and active circuits.

II. Background

Current sources are widely used to provide current for various circuits such as amplifiers, buffers, oscillators, and so on. Current sources may be used as bias circuits to provide bias currents, active loads to provide output currents, and so on. Current sources are often fabricated on integrated circuits (ICs) but may also be implemented with discrete circuit components.

As IC fabrication technology continues to improve, the size of transistors continues to shrink. The smaller transistor size enables more transistors and thus more complicated circuits to be fabricated on an IC die or, alternatively, a smaller die to be used for a given circuit. The smaller transistor size also supports faster operating speed and provides other benefits.

Complementary metal oxide semiconductor (CMOS) technology is widely used for digital circuits and many analog circuits. A major issue with shrinking transistor size in CMOS is leakage current, which is the current passing through a transistor when it is turned off. A smaller transistor geometry results in higher electric field (E-field), which stresses a transistor and causes oxide breakdown. To decrease the E-field, a lower power supply voltage is often used for smaller geometry transistors. However, the lower supply voltage also increases the propagation delay of the transistors, which is undesirable for high-speed circuits. To reduce the delay and improve operating speed, the threshold voltage ($V_t$) of the transistors is reduced. The threshold voltage determines the voltage at which the transistors turn on. However, the lower threshold voltage and smaller transistor geometry result in higher leakage current.

Leakage current is more problematic as CMOS technology scales smaller. This is because leakage current increases at a high rate with respect to the decrease in transistor size. Leakage current can impact the performance of certain circuits such as phase lock loops (PLLs), oscillators, digital-to-analog converters (DACs), and so on.

Some common techniques for combating leakage current include using high threshold voltage (high-$V_t$) transistors and/or larger transistor sizes (e.g., longer gate lengths). High-$V_t$ transistors may impact circuit performance (e.g., slower speed) and typically require an additional mask step in the IC fabrication process. Larger-size transistors are marginally effective at combating leakage current since (1) leakage current is a relatively weak function of channel length and (2) there are practical limits on how long the channel length may be extended. Both of these solutions may thus be inadequate for certain circuits.

There is therefore a need in the art for a current source with low leakage current and good performance.

SUMMARY

Low-leakage current sources and active circuits suitable for use in various circuit blocks (e.g., amplifiers, buffers, oscillators, DACs, and so on) are described herein. An active circuit is any circuit with at least one transistor, and a current source is one type of active circuit. For a low-leakage circuit, a transistor provides an output current when enabled in an ON state and presents low leakage current when disabled in an OFF state. Since leakage current is a strong function of threshold voltage, low leakage current is achieved by manipulating the voltages at the gate and source of the transistor to increase the threshold voltage of the transistor, which in turn decreases the leakage current.

In an embodiment, a circuit comprises first, second, and third transistors, which may be P-channel field effect transistors (P-FETs) or N-channel field effect transistors (N-FETs). The first transistor provides the output current when enabled and presents low leakage current when disabled. The second transistor couples to the first transistor and enables or disables the first transistor. The third transistor couples in series with the first transistor and connects or isolates the first transistor to/from a predetermined voltage, which may be a positive power supply voltage, circuit ground, a negative power supply voltage, a regulated voltage, or some other voltage. The circuit may further include a pass transistor that provides a reference voltage to the source of the first transistor when the first transistor is disabled. In the ON state, the first transistor provides the output current, and the second and third transistors do not impact performance. In the OFF state, the second and third transistors are used to provide the proper voltages to the first transistor to place it in a low-leakage state.

The first, second, and third transistors may be used for a low-leakage current source within a current mirror. In this case, the current mirror further includes fourth and fifth transistors. The fourth transistor is diode connected and receives a reference current from a current source. The fifth transistor couples in series with the fourth transistor. The first and third transistors mirror the fourth and fifth transistors, and the output current is related to the reference current. The low-leakage current source may be used as an active load (e.g., for an amplifier), a bias circuit to provide a bias current, and so on. The first, second, and third transistors may also be used for an amplifier stage. In this case, the first transistor may be operated as a gain transistor that provides signal gain.

Various aspects and embodiments of the invention are described in further detail below.

BRIEF DESCRIPTION OF THE DRAWINGS

The features and nature of the present invention will become more apparent from the detailed description set forth below when taken in conjunction with the drawings in which like reference characters identify correspondingly throughout.

DETAILED DESCRIPTION

The word "exemplary" is used herein to mean "serving as an example, instance, or illustration." Any embodiment or design described herein as "exemplary" is not necessarily to be construed as preferred or advantageous over other embodiments or designs.

The low-leakage current sources and active circuits described herein may be implemented in various technologies with adjustable transistor threshold voltage. Some exemplary technologies include P-channel metal-oxide semiconductor field effect transistors (MOSFETs), N-channel MOSFETs, and so on. For clarity, the following description is for circuits implemented with FETs and further assumes that (1) the bulk/substrate/body of an integrated circuit is tied to a low power supply ($V_{SS}$), which may be circuit ground, (2) the body of N-FETs are connected to the low power supply, and (3) the body of P-FETs are connected to a high power supply ($V_{DD}$). Also for simplicity, the low power supply is circuit ground in the following description.

Figure 1:
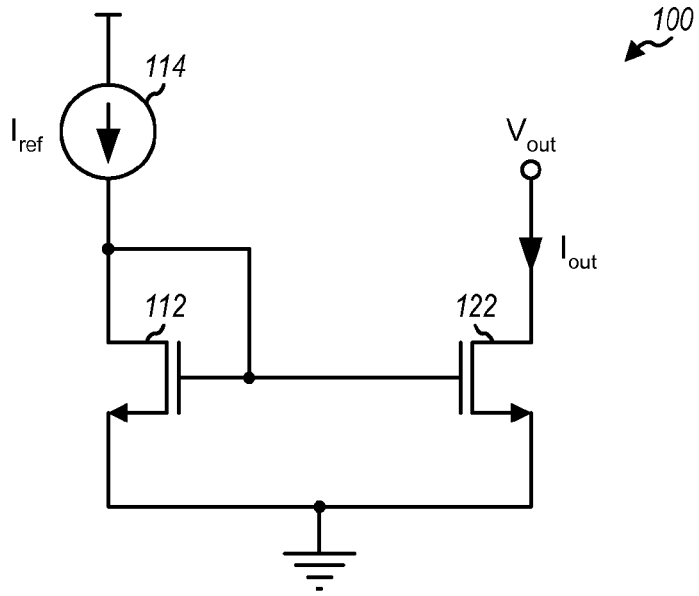
FIG. 1 shows a conventional current mirror.

FIG. 1 shows a schematic diagram of a conventional N-MOS current mirror 100. Current mirror 100 includes N-FETs 112 and 122 and a current source 114. N-FET 112 is diode connected and has it source coupled to circuit ground, its gate coupled to its drain, and its drain coupled to current source 114. Current source 114 provides a reference current of $I_{ref}$. N-FET 122 has its source coupled to circuit ground, its gate coupled to the gate of N-FET 112, and its drain providing an output current of $I_{out}$.

During normal operation, the gate-to-source voltage ($V_{gs}$) of N-FET 112 is set such that the $I_{ref}$ current from current source 114 passes through N-FET 112. The same $V_{gs}$ voltage is applied at N-FET 122 since the gates of N-FETs 112 and 122 are coupled together and the sources are also coupled together. If N-FET 122 is identical to N-FET 112, then N-FET 122 is forced to provide the same $I_{ref}$ current since the $V_{gs}$ voltage is the same for both N-FETs. N-FET 122 is thus a current source that mirrors N-FET 112. N-FET 122 may also be designed to provide an output current that is related to (and not necessarily equal to) the $I_{ref}$ current. The $I_{out}$ current from N-FET 122 is dependent on the $I_{ref}$ current flowing through N-FET 112 and the ratio of the size of N-FET 122 to the size of N-FET 112.

Current mirror 100 may be turned off by collapsing or turning off current source 114. When this occurs, only leakage currents flow through N-FETs 112 and 122, with the amount of leakage current being determined by various parameters such as the threshold voltage ($V_t$), the drain-to-source voltage ($V_{ds}$), and the gate-to-source voltage ($V_{gs}$) of these N-FETs. For certain applications, the leakage current of N-FET 122 may be too high, especially as transistor size shrinks.

Figure 2:
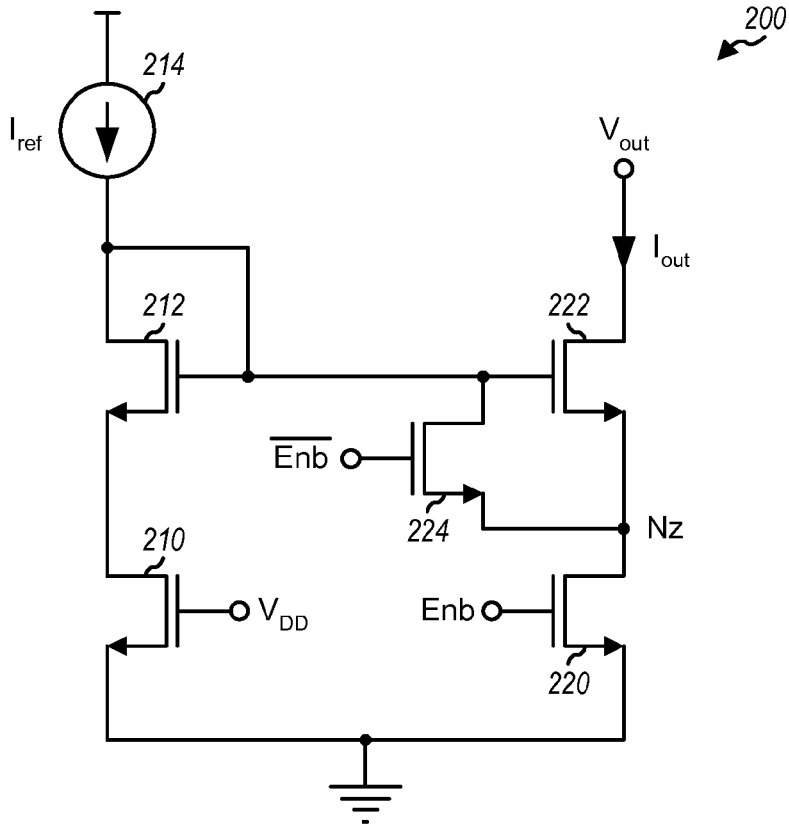
FIG. 2 shows an N-MOS low-leakage current mirror.

FIG. 2 shows a schematic diagram of an embodiment of an N-MOS low-leakage current mirror 200. Current mirror 200 includes N-channel N-FETs 210, 212, 220, 222, and 224 and a current source 214. N-FETs 210 and 212 and current source 214 are coupled in series. N-FET 210 has it source coupled to circuit ground, its gate coupled to the $V_{DD}$ supply voltage, and its drain coupled to the source of N-FET 212. N-FET 212 is diode connected and has its gate and drain coupled together and to current source 214, which provides a reference current of $I_{ref}$.

N-FETs 220 and 222 are coupled in series and form a low-leakage current source. N-FET 220 has its source coupled to circuit ground, its gate receiving an enable control signal (Enb), and its drain coupled to the source of N-FET 222. N-FET 222 has its gate coupled to the gate of N-FET 212 and its drain providing an output current of $I_{out}$. N-FET 224 has its source coupled to the source of N-FET 222, its gate receiving a complementary enable control signal ($\overline{\text{Enb}}$), and its drain coupled to the gates of N-FETs 212 and 222.

N-FETs 210, 212, 220, and 222 are coupled such that the current flowing through N-FETs 220 and 222 mirrors the current flowing through N-FETs 210 and 212. N-FETs 210 and 220 may be scaled in size relative to N-FETs 212 and 222. N-FET 222 is an output transistor that provides the $I_{out}$ current. N-FET 220 acts as a switch that connects or isolates the source of N-FET 222 to/from circuit ground. N-FET 224 is a control transistor that enables or disables N-FET 222. Current mirror 200 operates as described below.

Figure 3A:
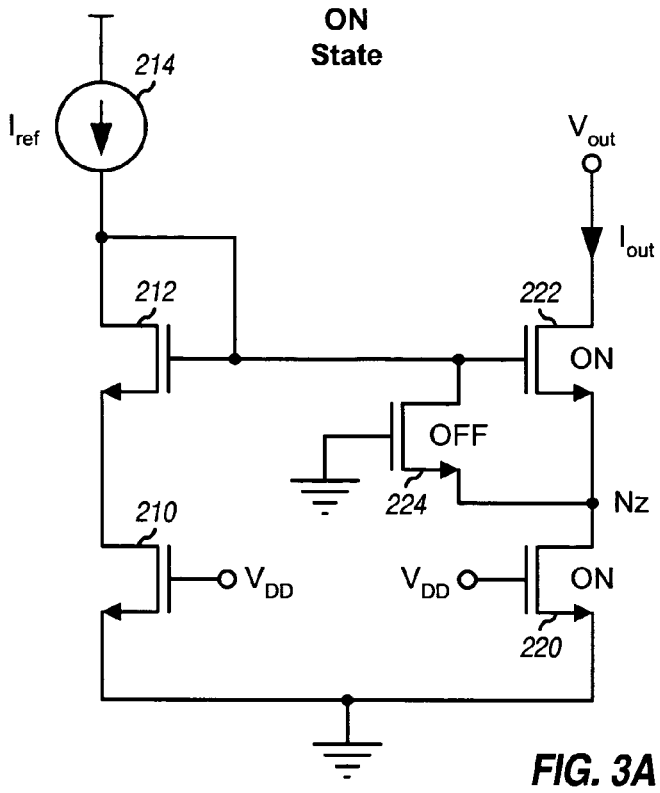
FIGS. 3A and 3B show the low-leakage current mirror of FIG. 2 in the ON and OFF states, respectively.

FIG. 3A shows low-leakage current mirror 200 in the ON state, which may also be called an active state or some other name. In the ON state, the Enb signal is at logic high and the $\overline{\text{Enb}}$ signal is at logic low. N-FET 210 is always turned on, and the $V_{gs}$ voltage of N-FET 212 is set such that the $I_{ref}$ current from current source 214 flows through N-FET 212. N-FET 220 is turned on by the logic high on the Enb signal, and the voltage at node Nz is determined by the $V_{ds}$ voltage of N-FET 220, which is typically small for a switch, e.g., several millivolts (mV). N-FET 224 is turned off by the logic low on the $\overline{\text{Enb}}$ signal. The same gate voltage ($V_g$) is applied at both N-FETs 212 and 222 since the gates of these N-FETs are coupled together. N-FET 222 is turned on and provides the $I_{out}$ current. This $I_{out}$ current is dependent on (1) the $I_{ref}$ current flowing through N-FETs 210 and 212 and (2) the ratio of the sizes of N-FETs 220 and 222 to the sizes of N-FETs 210 and 212. In the ON state, current mirror 200 behaves like conventional current mirror 100, albeit with a small resistive degeneration due to N-FETs 210 and 220.

Figure 3B:
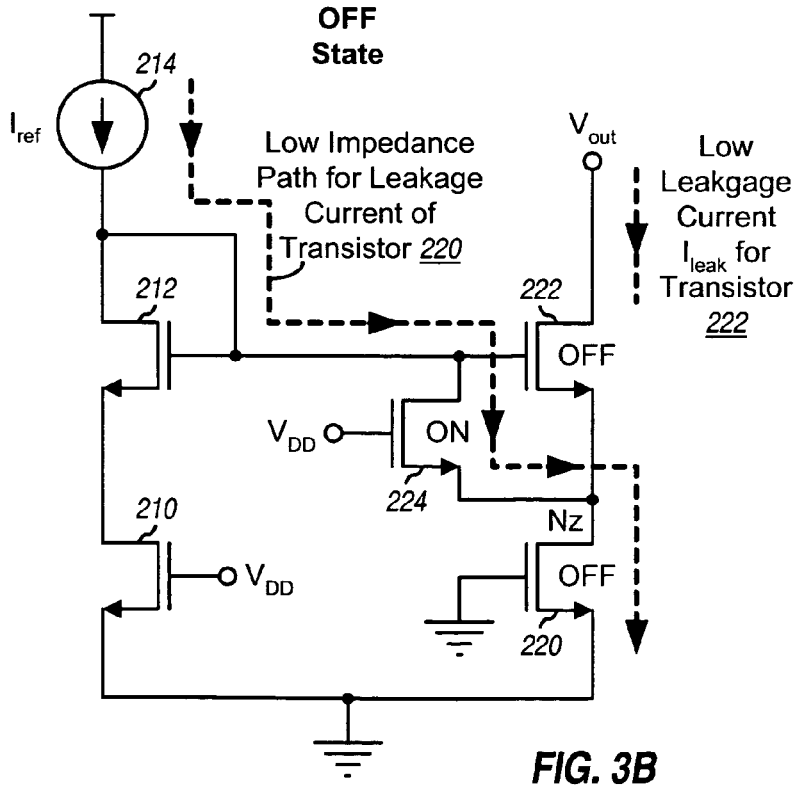

FIG. 3B shows low-leakage current mirror 200 in the OFF state, which may also be called a low-leakage state or some other name. In the OFF state, the Enb signal is at logic low and the $\overline{\text{Enb}}$ signal is at logic high. N-FET 220 is turned off by the logic low on the Enb signal and isolates the source of N-FET 222 from circuit ground. N-FET 224 is turned on by the logic high on the $\overline{\text{Enb}}$ signal, which results in a zero or low $V_{ds}$ voltage for N-FET 224. The $V_{gs}$ voltage of N-FET 222 is equal to the $V_{ds}$ voltage of N-FET 224 because the drain of N-FET 224 is coupled to the gate of N-FET 222 and the sources of these N-FETs are coupled together. N-FET 222 is turned off because of the zero or low $V_{gs}$ voltage, as long as the drain voltage of N-FET 222 is sufficiently high.

Table 1 summarizes the logic values of the control signals, the states of N-FETs 220, 222, and 224, the current via N-FET 222, and the voltage at node Nz for the ON and OFF states.

TABLE 1

| Current Mirror 200 | | |
|---|---|---|
| | ON State | OFF State |
| Enb Signal | High | Low |
| $\overline{\text{Enb}}$ Signal | Low | High |
| N-FET 220 | ON | OFF |
| N-FET 222 | ON | OFF |
| N-FET 224 | OFF | ON |
| Current via N-FET 222 | $I_{out}$ | $I_{leak}$ |
| Voltage at Node Nz | ~0 V | ON $V_{gs}$ |

In the OFF state, low leakage current is achieved for N-FET 222 via several mechanisms. First, the $V_{gs}$ voltage of N-FET 222 is zero or a low value due to N-FET 224 being turned on. Second, the source voltage ($V_s$) of N-FET 222 is raised higher than circuit ground. This is achieved by turning off N-FET 220 and isolating the source of N-FET 222, which results in node Nz being a high impedance (hi-Z) node. The voltage at node Nz is then raised higher by diode-connected N-FET 212 and switched-on N-FET 224 and is approximately equal to the $V_{gs}$ voltage of switched-on N-FET 212.

The ON $V_{gs}$ voltage of N-FET 212 is determined by the $I_{ref}$ current as well as the dimension of N-FET 212. If the bulk/substrate of the integrated circuit is tied to circuit ground, then the source-to-bulk voltage ($V_{sb}$) of N-FET 224 is increased by raising the voltage at node Nz. The higher $V_{sb}$ voltage increases the threshold voltage $V_t$ of N-FET 222, which then decreases the leakage current through N-FET 222.

The threshold voltage $V_t$ is a function of the $V_{sb}$ voltage and may be expressed as:

$$V_t = V_{t0} + \gamma \cdot (\sqrt{2\phi_f + V_{sb}} - \sqrt{2\phi_f}), \quad \text{Eq (1)}$$

where $\gamma$ is a parameter that is dependent on electrical characteristics of the transistor;

$\phi_f$ is a Fermi potential; and $V_{t0}$ is the threshold voltage with $V_{sb}$=0 volt.

If the $V_{gs}$ voltage is less than the ON voltage of the transistor, then the leakage current increases linearly with an increasing $V_{ds}$ voltage and further decreases exponentially as the $V_{th}$ voltage is increased. A small leakage current may be obtained with a $V_{gs}$ voltage that turns off N-FET 222, a $V_{ds}$ voltage that is as small as possible, and a threshold voltage that is as high as possible. A transfer function for drain current ($I_d$) versus $V_{gs}$ voltage for a MOS transistor resembles the well-known transfer function for a diode. The drain current for the MOS transistor is small for a $V_{gs}$ voltage that is less than a "knee" voltage, which may be several hundred mV. Thus, low leakage current may be achieved by applying a sufficiently small $V_{gs}$ voltage to N-FET 222. Leakage current is a strong function of the threshold voltage. Thus, low leakage current may be achieved by manipulating the gate and source voltages of N-FET 222 to increase the threshold voltage. In addition, the leakage current of N-FET 220 flows through N-FET 224, which presents a lower impedance path than N-FET 222. Low leakage current thus flows through N-FET 222 in the OFF state.

The gate voltage of N-FET 222 may be set to a lower voltage that ensures that the gate-to-drain voltage ($V_{gd}$) of N-FET 222 is not forward biased when N-FET 222 is turned off. This may be achieved by reducing the $I_{ref}$ current of current source 214 in the OFF state, which then reduces the $V_{gs}$ voltage of N-FET 212, which in turn reduces the gate voltage of N-FET 222. For example, the $V_{gs}$ voltage of N-FET 212 may be reduced to less than a diode voltage drop (e.g., reduced to between 200 to 300 mV), which then ensures that N-FET 222 will not be forward biased even if the voltage at the output node (Vout) drops to 0 mV. A different biasing scheme would then be needed for in this case.

Exemplary designs of conventional current mirror 100 in FIG. 1 and low-leakage current mirror 200 in FIG. 2, with comparable $I_{out}$ current and transistor sizes, were evaluated. The leakage current of N-FET 122 within current mirror 100 is up to 100 nano-Amperes (nA). In contrast, the leakage current of N-FET 222 within current mirror 200 is approximately 70 pico-Amperes (pA). The low-leakage design shown in FIG. 2 can thus substantially reduce the amount of leakage current (by a factor of more than 1000 for the exemplary designs). The low leakage current is highly desirable for many low-leakage applications, as described below.

Figure 4:
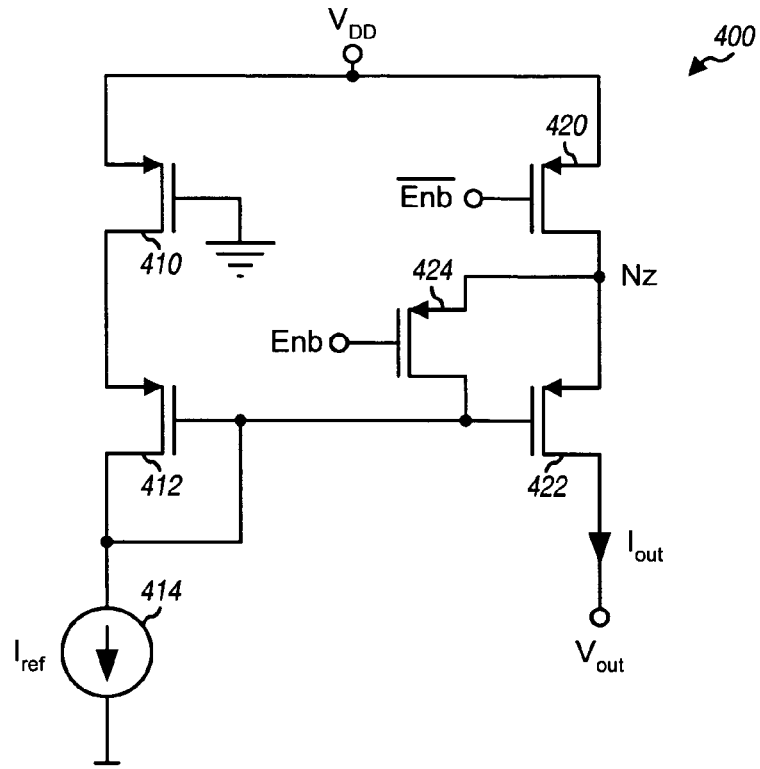
FIG. 4 shows a P-MOS low-leakage current mirror.

FIG. 4 shows a schematic diagram of an embodiment of a P-MOS low-leakage current mirror 400. Current mirror 400 includes P-FETs 410, 412, 420, 422, and 424 and a current source 414. P-FETs 410 and 412 and current source 414 are coupled in series. P-FET 410 has it source coupled to the $V_{DD}$ power supply, its gate coupled to circuit ground, and its drain coupled to the source of P-FET 412. P-FET 412 is diode connected and has its gate and drain coupled together and to current source 414, which provides a reference current of $I_{ref}$.

P-FETs 420 and 422 are coupled in series and form a low-leakage current source. P-FET 420 has its source coupled to the $V_{DD}$ power supply, its gate receiving the $\overline{\text{Enb}}$ signal, and its drain coupled to the source of P-FET 422. P-FET 422 has its gate coupled to the gate of P-FET 412 and its drain providing an output current of $I_{out}$. P-FET 424 has its source coupled to the source of P-FET 422, its gate receiving the Enb signal, and its drain coupled to the gates of P-FETs 412 and 422.

P-FETs 410, 412, 420, and 422 are coupled such that the current flowing through P-FETs 420 and 422 mirrors the current flowing through P-FETs 410 and 412. P-FET 422 is an output transistor that provides the $I_{out}$ current. P-FET 420 acts as a switch that connects or isolates the source of P-FET 422 to/from the $V_{DD}$ power supply. P-FET 424 is a control transistor that enables or disables P-FET 422. Current mirror 400 operates as described below.

In the ON state, the Enb signal is at logic high and the $\overline{\text{Enb}}$ signal is at logic low. P-FET 410 is always turned on, and the $V_{gs}$ voltage of P-FET 412 is set such that the $I_{ref}$ current from current source 414 passes through P-FET 412. P-FET 420 is turned on by the logic low on the $\overline{\text{Enb}}$ signal, and P-FET 424 is turned off by the logic high on the Enb signal. P-FET 422 is turned on and provides the $I_{out}$ current, which is dependent on the $I_{ref}$ current and the ratio of the sizes of P-FETs 420 and 422 to the sizes of P-FETs 410 and 412.

In the OFF state, P-FET 420 is turned off by the logic high on the $\overline{\text{Enb}}$ signal, and P-FET 424 is turned on by the logic low on the Enb signal. The zero or low $V_{ds}$ voltage for P-FET 424 turns off P-FET 422. Low leakage current is achieved for P-FET 422 by (1) turning off P-FET 420 to obtain high impedance at node Nz and (2) bringing the source voltage of P-FET 422 lower via P-FETs 412 and 424. This causes the threshold voltage $V_t$ of P-FET 422 to increase, which decreases the leakage current through P-FET 422. In addition, the leakage current of P-FET 420 is funneled through P-FET 424, which presents a lower impedance path than P-FET 422. Low leakage current thus flows through P-FET 422 in the OFF state.

Figure 5:
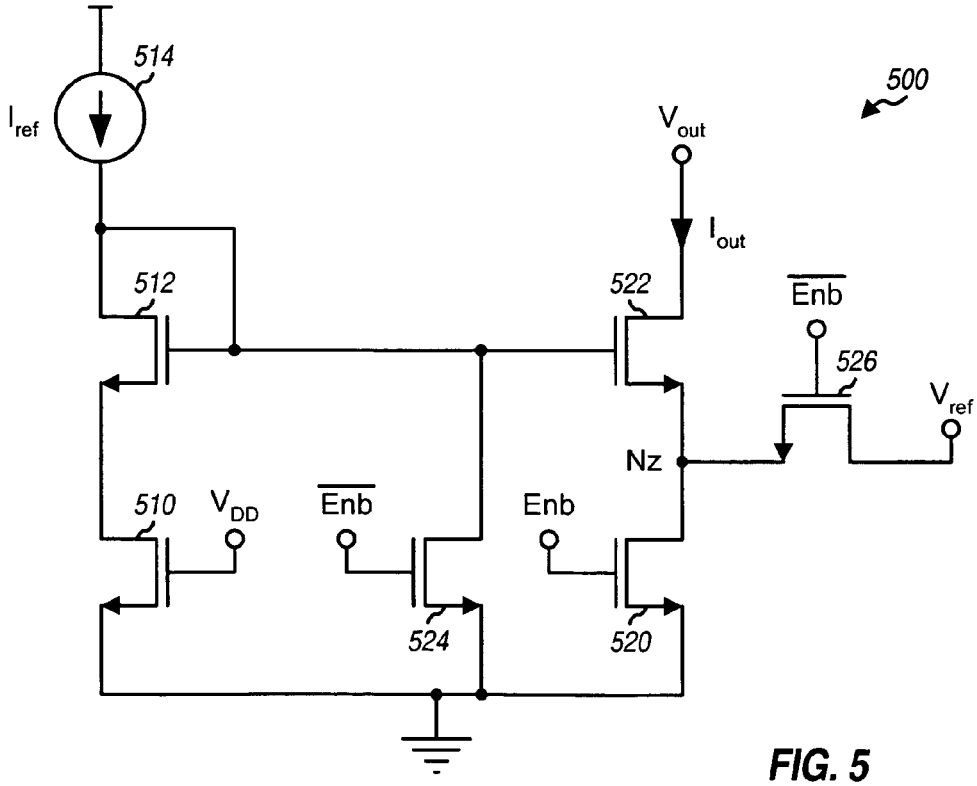
FIG. 5 shows another N-MOS low-leakage current mirror.

FIG. 5 shows a schematic diagram of another embodiment of an N-MOS low-leakage current mirror 500. Current mirror 500 includes N-FETs 510, 512, 520, 522, 524 and 526 and a current source 514. N-FETs 510 and 512 and current source 514 are coupled in series and in the same manner as N-FETs 210 and 212 and current source 214, respectively, in FIG. 2. N-FETs 520 and 522 are also coupled in series and form a low-leakage current source. N-FET 524 has its source coupled to circuit ground, its gate receiving the $\overline{\text{Enb}}$ signal, and its drain coupled to the gates of N-FETs 512 and 522. N-FET 526 has its source coupled to the source of N-FET 522, its gate receiving the $\overline{\text{Enb}}$ signal, and its drain coupled to a reference voltage of $V_{ref}$. N-FET 510 is always turned on.

Transistors 510, 512, 520, and 522 are coupled such that the current flowing through N-FETs 520 and 522 mirrors the current flowing through N-FETs 510 and 512. N-FET 522 is an output transistor that provides the $I_{out}$ current. N-FET 520 acts as a switch that connects or isolates the source of N-FET 522 to/from circuit ground. N-FET 524 is a control transistor that enables or disables N-FET 522. N-FET 526 is a pass transistor that, when enabled, couples the $V_{ref}$ voltage to node Nz. Current mirror 500 operates as described below.

In the ON state, N-FET 520 is turned on by the logic high on the Enb signal, and N-FETs 524 and 526 are both turned off by the logic low on the $\overline{\text{Enb}}$ signal. N-FET 522 is turned on by the gate voltage of N-FET 512 and provides the $I_{out}$ current, which is dependent on the $I_{ref}$ current and the ratio of the sizes of N-FETs 520 and 522 to the sizes of N-FETs 510 and 512.

In the OFF state, N-FET 520 is turned off by the logic low on the Enb signal, and N-FETs 524 and 526 are both turned on by the logic high on the $\overline{\text{Enb}}$ signal. The zero or low $V_{ds}$ voltage for N-FET 524 turns off N-FET 522. Low leakage current is achieved for N-FET 522 by (1) turning off N-FET 520 to obtain high impedance at node Nz and (2) providing the $V_{ref}$ voltage to the source of N-FET 522 via N-FET 526. This increases the threshold voltage of N-FET 522, which decreases the leakage current through N-FET 522. In addition, the leakage current of N-FET 520 flows through N-FET 526, which presents a lower impedance path than N-FET 522.

For current mirror 500, a $V_{ds}$ voltage of zero volts may be achieved for N-FET 522 in the OFF state, for example, by buffering the $V_{out}$ voltage at the drain of N-FET 522 and using this buffered voltage as the $V_{ref}$ voltage, which is then provided to the source of N-FET 522 via N-FET 526. If this feedback mechanism is not utilized and if the $V_{out}$ voltage is not known, then the $V_{ref}$ voltage may be set to $V_{DD}/2$ or to the expected voltage at the drain of N-FET 522.

As indicated by the various embodiments described above, low leakage for an output transistor (e.g., N-FET 222, 422, or 522) that provides an output current may be achieved by (1) applying a low, zero, or reverse biased $V_{gs}$ voltage to turn off the output transistor and (2) bringing the source of the output transistor away from the supply voltage (e.g., $V_{DD}$ or $V_{SS}$) and toward the $V_{out}$ voltage. The second part may be achieved by isolating the source of the output transistor with a switch transistor (e.g., FET 220, 420, or 520) and manipulating the voltage at the source of the output transistor (e.g., with FET 224, 424, or 526).

Figure 6:
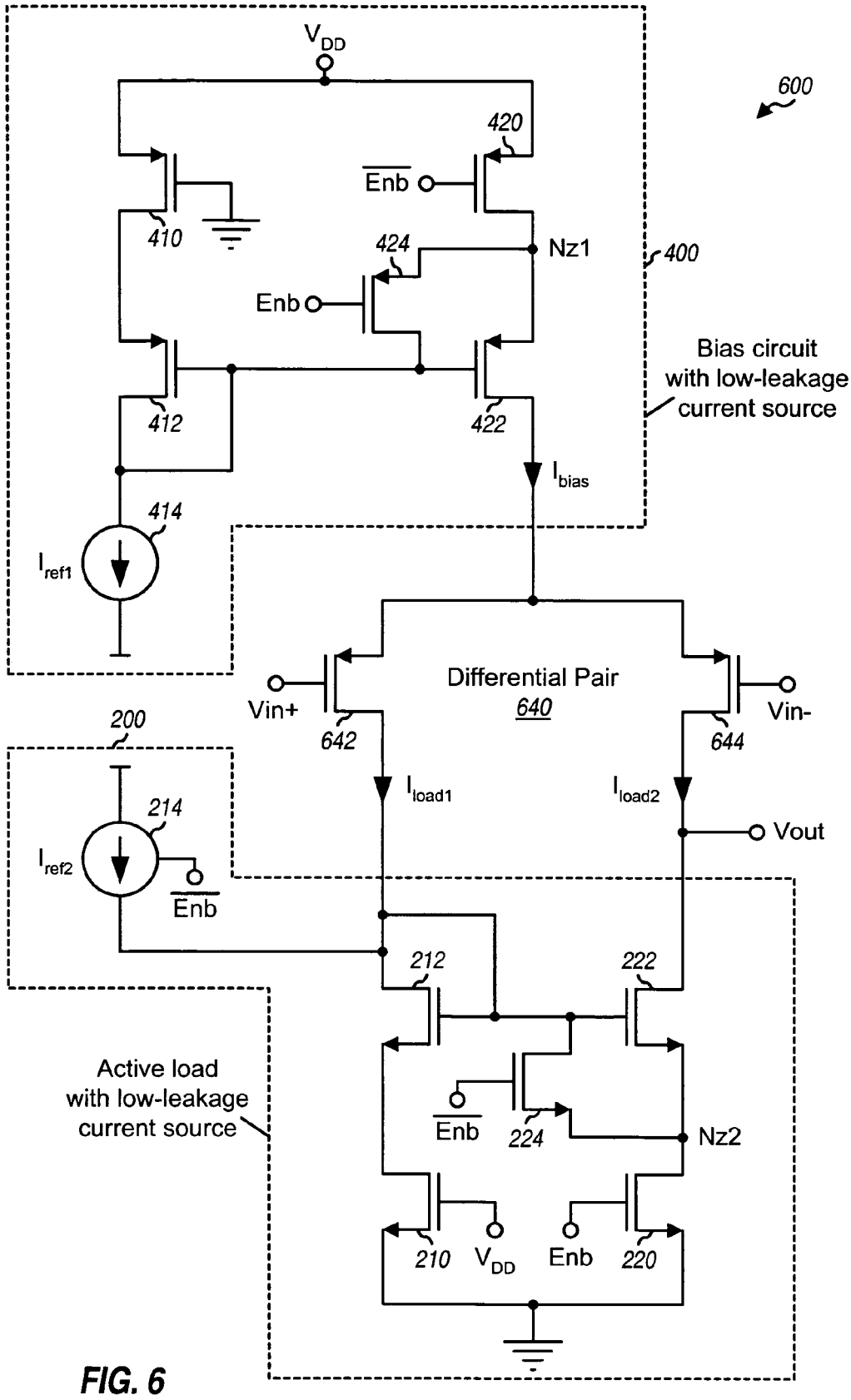
FIG. 6 shows a single-stage amplifier utilizing the low-leakage current sources in FIGS. 2 and 4.

FIG. 6 shows a schematic diagram of an embodiment of a single-stage amplifier 600 utilizing the low-leakage current sources in FIGS. 2 and 4. Amplifier 600 includes a differential pair 640, N-MOS load circuit 200, and P-MOS low-leakage current mirror 400. Differential pair 640 includes P-FETs 642 and 644 having their sources coupled together and their gates receiving a non-inverting input signal (Vin+) and an inverting input signal (Vin−), respectively. P-MOS low-leakage current mirror 400 is coupled as described above for FIG. 4. The drain of P-FET 422 couples to the sources of P-FETs 642 and 644 and provides a bias current of $I_{bias}$ for differential pair 640.

N-MOS load circuit 200 is coupled as described above for FIG. 2, albeit with current source 214 being controlled by the $\overline{\text{Enb}}$ signal. The drain of N-FET 212 couples to the drain of P-FET 642 and provides a load current of $I_{load1}$. The drain of N-FET 222 couples to the drain of P-FET 644 and provides a load current of $I_{load2}$. Load circuit 200 is the active load for differential pair 640. In steady state, with the same voltage being applied to the gates of P-FETs 642 and 644, the $I_{load1}$ current flowing through FETs 642 and 212 is equal to the $I_{load2}$ current flowing through FETs 644 and 222, and the bias current is equal to the sum of both load currents (i.e., $I_{bias}=I_{load1}+I_{load2}$) Amplifier 600 operates as follows.

In the ON state, the logic high on the Enb signal turns on N-FET 220 and turns off P-FET 424, and the logic low on the $\overline{\text{Enb}}$ signal turns on P-FET 420 and turns off N-FET 224. Current source 400 is turned on and provides the bias current for differential pair 640. Load circuit 200 is also turned on (albeit with current source 214 being turned off) and acts as the active load for differential pair 640. Differential pair 640 receives and amplifies the differential input signal (Vin+ and Vin−) and provides an output signal (Vout).

In the OFF state, the logic low on the Enb signal turns off N-FET 220 and turns on P-FET 424, and the logic high on the $\overline{\text{Enb}}$ signal turns off P-FET 420 and turns on N-FET 224. P-FET 422 is turned off by the zero or low $V_{gs}$ voltage with P-FET 424 being turned on, and low leakage current flows through P-FET 422. Similarly, N-FET 222 is turned off by the zero or low $V_{gs}$ voltage with N-FET 224 being turned on, and low leakage current flows through N-FET 222 and hence the output of amplifier 600. Current source 214 is turned on within load circuit 200, provides a low impedance path for the leakage current of N-FET 220, and raises the gate voltage of N-FET 222.

Figure 7:
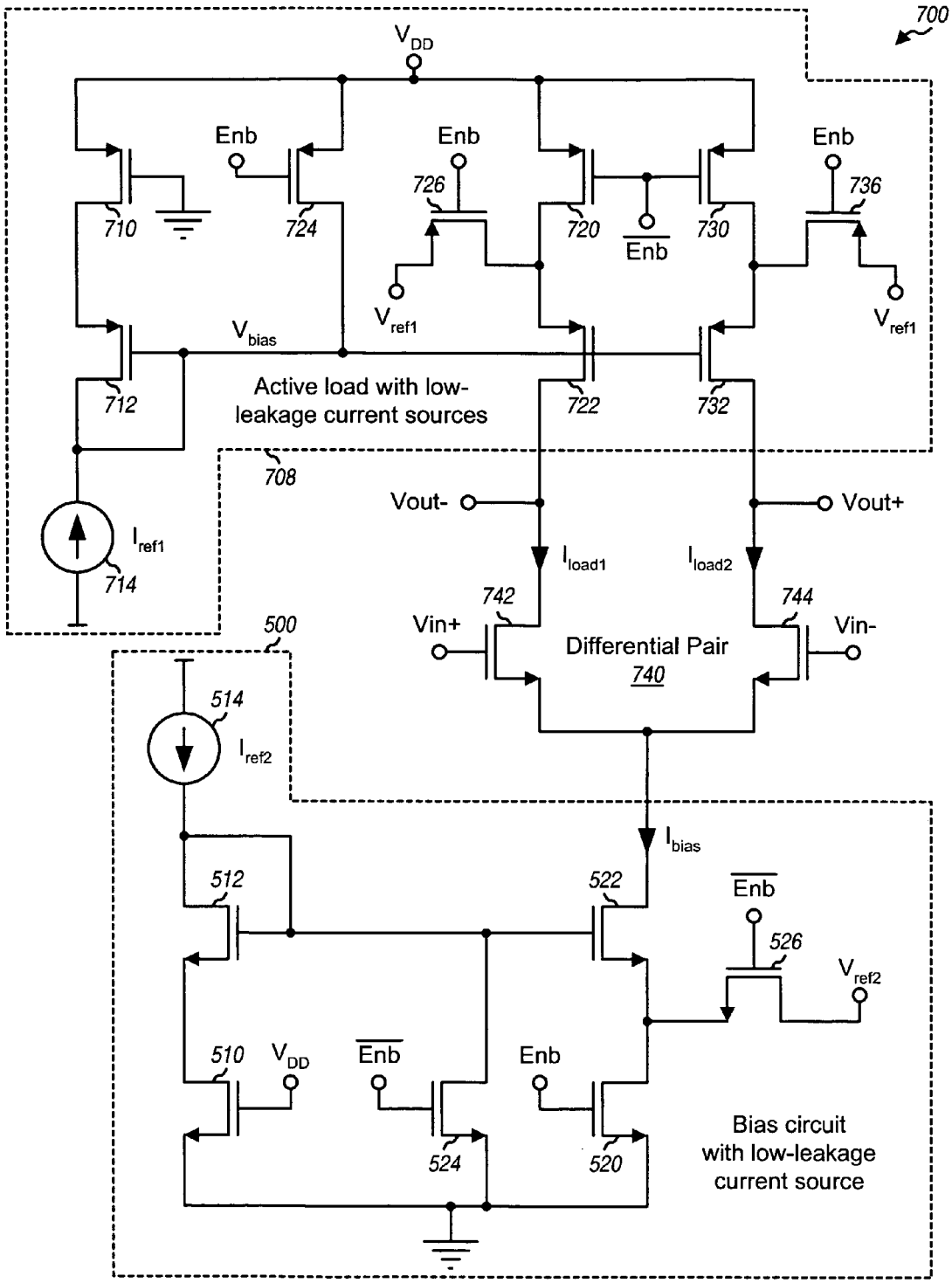
FIGS. 7 and 8 show two single-stage amplifiers utilizing the low-leakage current source in FIG. 5.

FIG. 7 shows a schematic diagram of another embodiment of a single-stage amplifier 700 utilizing the low-leakage current source in FIG. 5. Amplifier 700 includes a differential pair 740, N-MOS low-leakage current mirror 500, and a P-MOS load circuit 708. Differential pair 740 includes N-FETs 742 and 744 having their sources coupled together and their gates receiving the Vin+ and Vin− input signals, respectively. N-MOS low-leakage current mirror 500 is coupled as described above for FIG. 5. The drain of N-FET 522 couples to the sources of N-FETs 742 and 744 and provides a bias current of $I_{bias}$ for differential pair 740.

P-MOS load circuit 708 includes P-FETs 710, 712, 720, 722, 724, and 726 and a current source 714 that are coupled in a complementary manner as N-FETs 510, 512, 520, 522, 524, and 526 and current source 514, respectively, for current mirror 500. P-FET 712 provides a bias voltage $V_{bias}$ that may also be generated with other circuits. Load circuit 708 further includes P-FETs 730, 732, and 736 that are coupled in the same manner as P-FETs 720, 722, and 726, respectively. The drain of P-FET 722 couples to the drain of N-FET 742 and provides a load current of $I_{load1}$. The drain of P-FET 732 couples to the drain of N-FET 744 and provides a load current of $I_{load2}$. P-FETs 722 and 732 are biased in a triode region of operation and are the loads for differential pair 740. Load circuit 708 is the active load for differential pair 740. Amplifier 700 operates as follows.

In the ON state, the logic high on the Enb signal turns on N-FET 520 and turns off P-FETs 724, 726, and 736, and the logic low on the $\overline{\text{Enb}}$ signal turns on P-FETs 720 and 730 and turns off N-FETs 524 and 526. Current source 500 is turned on and provides the bias current for differential pair 740. Load circuit 708 is also turned on and acts as the active load for differential pair 740. Differential pair 740 receives and amplifies the differential input signal (Vin+ and Vin−) and provides a differential output signal (Vout+ and Vout−).

In the OFF state, the logic low on the Enb signal turns off N-FET 520 and turns on P-FETs 724, 726, and 736, and the logic high on the $\overline{\text{Enb}}$ signal turns off P-FETs 720 and 730 and turns on N-FETs 524 and 526. N-FET 522 is turned off by a zero or low gate voltage with N-FET 524 being turned on. N-FET 526 provides a reference voltage of $V_{ref2}$ to the source of N-FET 522, which increases the threshold voltage of N-FET 522 and results in low leakage current flowing through N-FET 522. Similarly, P-FETs 722 and 732 are turned off by a high gate voltage with P-FET 724 being turned on. P-FETs 726 and 736 provide a reference voltage of $V_{ref1}$ to the sources of P-FETs 722 and 732, respectively, which increases the threshold voltage of P-FETs 722 and 732 and results in low leakage current flowing through P-FETs 722 and 732 and hence the output of amplifier 700.

Figure 8:
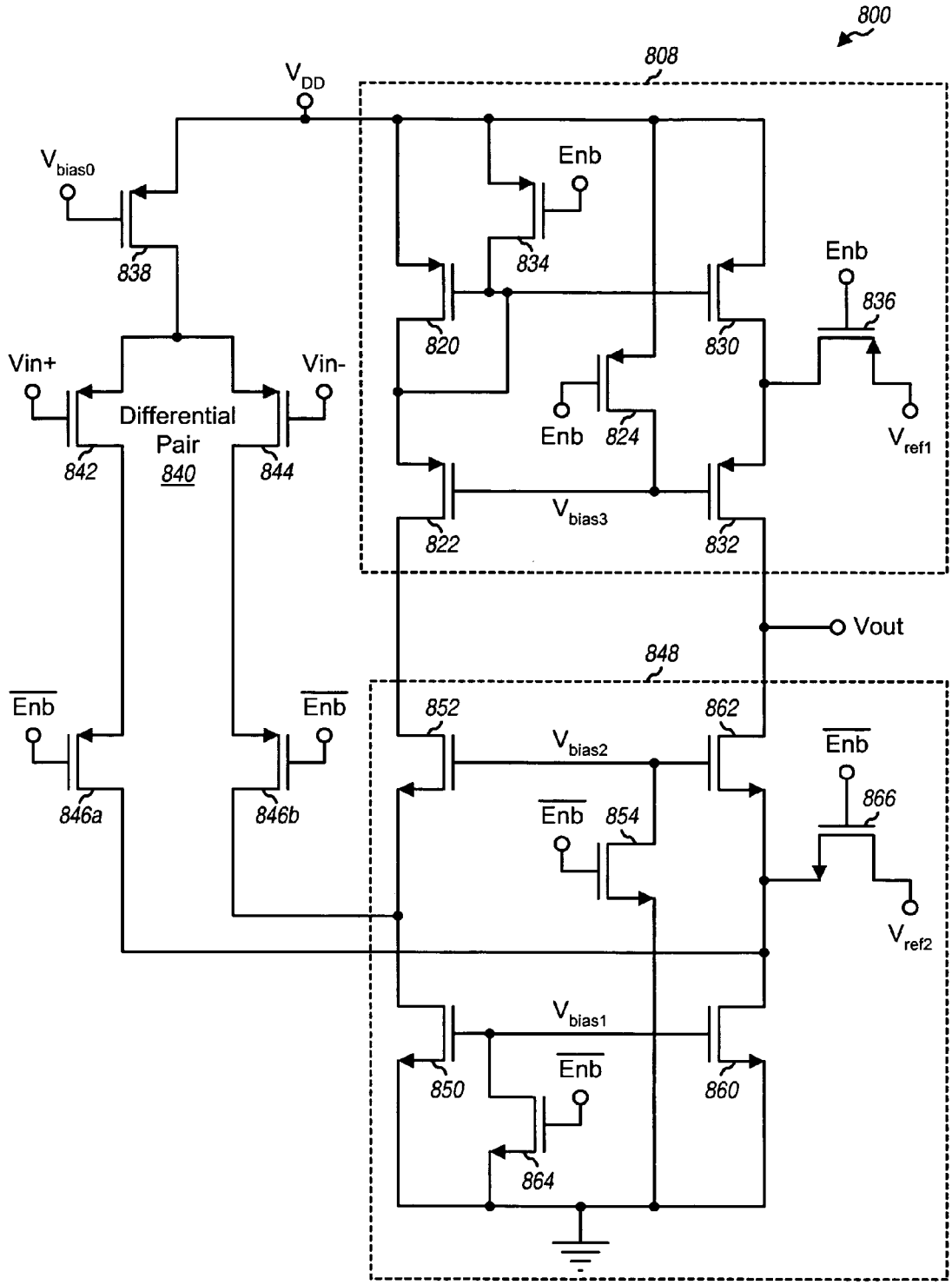

FIG. 8 shows a schematic diagram of yet another embodiment of a single-stage amplifier 800 utilizing a folded cascode topology. Amplifier 800 includes a differential pair 840, pass P-FETs 846*a* and 846*b*, a P-MOS load circuit 808, and an N-MOS load circuit 848. Differential pair 840 includes P-FETs 842 and 844 having their sources coupled together and their gates receiving the Vin+ and Vin− input signals, respectively. A P-FET 838 has a source that couples to the $V_{DD}$ supply voltage, a gate that receives a bias voltage of $V_{bias0}$, and a drain that couples to the sources of P-FETs 842 and 844. P-FET 838 provides the bias current for differential pair 840 and may be replaced with current mirror 400, as shown in FIG. 6. P-FETs 846*a* and 846*b* act as switches that, when turned on, couple the drains of P-FETs 842 and 844 to the drains of N-FETs 860 and 850, respectively.

Load circuit 808 includes P-FETs 820, 822, 824, 830, 832 and 836 that are coupled in the similar manner as P-FETs 720, 722, 724, 730, 732 and 736, respectively, in FIG. 7. Load circuit 808 further includes a P-FET 834 having its source coupled to the $V_{DD}$ supply voltage, its gate receiving the Enb signal, and its drain coupled to the gates of P-FETs 820 and 830. Load circuit 808 acts as an active load for the output stage of amplifier 800.

Load circuit 848 includes N-FETs 850, 852, 854, 860, 862, 864 and 866 that are coupled in the complementary manner as P-FETs 820, 822, 824, 830, 832, 834 and 836, respectively, in load circuit 808. The gates of N-FETs 850 and 860 have a bias voltage of $V_{bias1}$. The gates of N-FETs 852 and 862 have a bias voltage of $V_{bias2}$. Load circuit 848 provides a bias current for the output stage of amplifier 800. Amplifier 800 operates as follows.

In the ON state, the logic high on the Enb signal turns off P-FETs 824, 834 and 836, and the logic low on the $\overline{\text{Enb}}$ signal turns off N-FETs 854, 864 and 866. Load circuits 808 and 848 are both turned on and provide the output current for amplifier 800. Load circuit 848 presents low impedance to different pair 840 and high impedance for the amplifier output.

In the OFF state, the logic low on the Enb signal turns on P-FETs 824, 834 and 836, and the logic high on the $\overline{\text{Enb}}$ signal turns on N-FETs 854, 864 and 866. P-FET 836 provides a reference voltage of $V_{ref1}$ to the source of P-FET 832, which results in low leakage current flowing through P-FET 832. Similarly, N-FET 866 provides a reference voltage of $V_{ref2}$ to the source of N-FET 862, which results in low leakage current flowing through N-FET 862.

Figure 9:
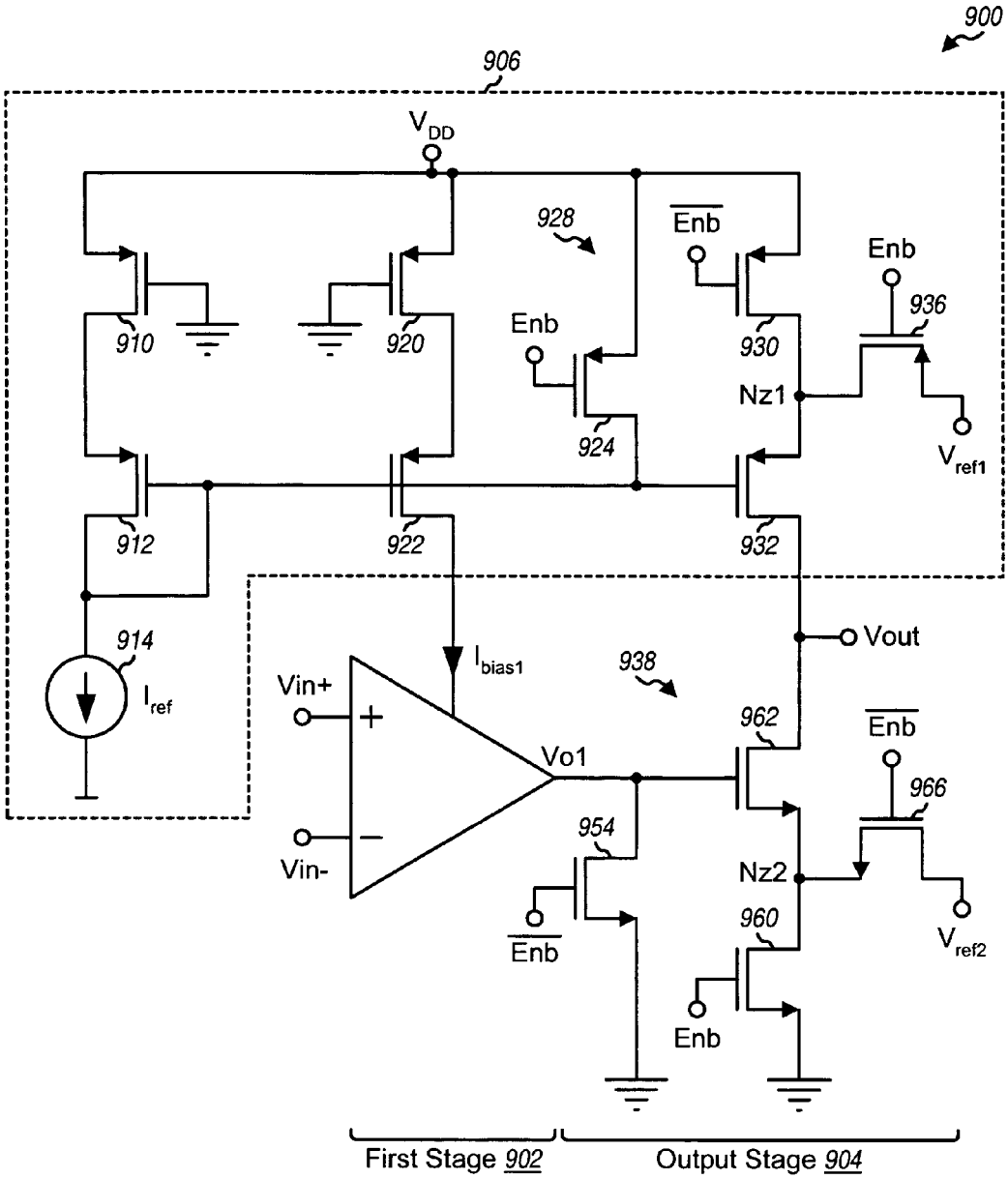
FIG. 9 shows a dual-stage amplifier utilizing low-leakage circuits.

FIG. 9 shows a schematic diagram of an embodiment of a dual-stage amplifier 900 utilizing low-leakage current sources and active circuits. Amplifier 900 includes a first stage 902, an output stage 904, and a load circuit 906. First stage 902 may be implemented with various designs, e.g., with differential pair 640 and current mirror 200 as shown in FIG. 6. Output stage 904 includes a common-source amplifier 938 and an active load that is implemented with a low-leakage current source 928.

Within load circuit 906, P-FETs 910 and 912 and a current source 914 are coupled in series and in the same manner as P-FETs 410 and 412 and current source 414, respectively, in FIG. 4. P-FETs 920 and 922 are coupled in series and form a load circuit for first stage 902. P-FETs 910, 912, 920, and 922 are also coupled such that the average current flowing through P-FETs 920 and 922 is related to the current flowing through P-FETs 910 and 912.

Load circuit 928 includes P-FETs 924, 930 and 932 that are coupled in the same manner as P-FETs 824, 830 and 832, respectively, in FIG. 8. Load circuit 928 is the active load for output stage 904 and is also part of load circuit 906.

Common-source amplifier 938 includes N-FETs 954, 960, 962 and 966 that are coupled in the same manner as N-FETs 854, 860, 862 and 866, respectively, in FIG. 8. The gate of N-FET 962 is the input of output stage 904 and is coupled to the output of first stage 902. The drain of N-FET 962 is the output of output stage 904 and is coupled to the drain of N-FET 932 within load circuit 928. Amplifier 900 operates as follows.

In the ON state, the logic high on the Enb signal turns on N-FET 960 and turns off P-FET 924, and the logic low on the $\overline{\text{Enb}}$ signal turns on P-FET 930 and turns off N-FET 954. Load circuit 928 is turned on and provides the bias current for common-source amplifier 938. Common-source amplifier 938 is also enabled, receives and amplifies the output signal (Vol) from first stage 902, and provides the output signal (Vout) for amplifier 900.

In the OFF state, the logic low on the Enb signal turns off N-FET 960 and turns on P-FET 924, and the logic high on the $\overline{\text{Enb}}$ signal turns off P-FET 930 and turns on N-FET 954. P-FET 932 is turned off by the zero or low $V_{gs}$ voltage with P-FET 924 being turned on, load circuit 928 is turned off, and low leakage current flows through P-FET 932. Similarly, N-FET 962 is turned off by the zero or low $V_{gs}$ voltage with N-FET 954 being turned on, common-source amplifier 938 is disabled, and low leakage current flows through N-FET 962. P-FET 932 and N-FET 962 present low leakage currents to the output of amplifier 900.

For the embodiment shown in FIG. 9, only output stage 904 is disabled in the OFF state. First stage 902 may also be disabled in the OFF state by providing the gate of P-FET 920 with the $\overline{\text{Enb}}$ signal.

In general, an amplifier may include any number of stages. To obtain low leakage current in the OFF state, the output stage of the amplifier may utilize low-leakage current sources for the biasing circuit (e.g., as shown in FIGS. 6 through 8) and/or low-leakage current sources for the active load (e.g., as shown in FIGS. 6 through 9). The output stage may also utilize a low-leakage active circuit for the gain portion of the stage (e.g., as shown in FIG. 9).

Low-leakage current sources and active circuits described herein may be used for various circuit blocks such as amplifiers (e.g., as shown in FIGS. 6 through 9), unity gain buffers, charge pumps, active loop filters, DACs, and other circuit blocks where low leakage is desirable. The low-leakage current sources and active circuits may also be used for various applications such as PLL, automatic gain control (AGC), time tracking loop, and so on. The use of low-leakage circuits for an exemplary PLL is described below.

Figure 10:
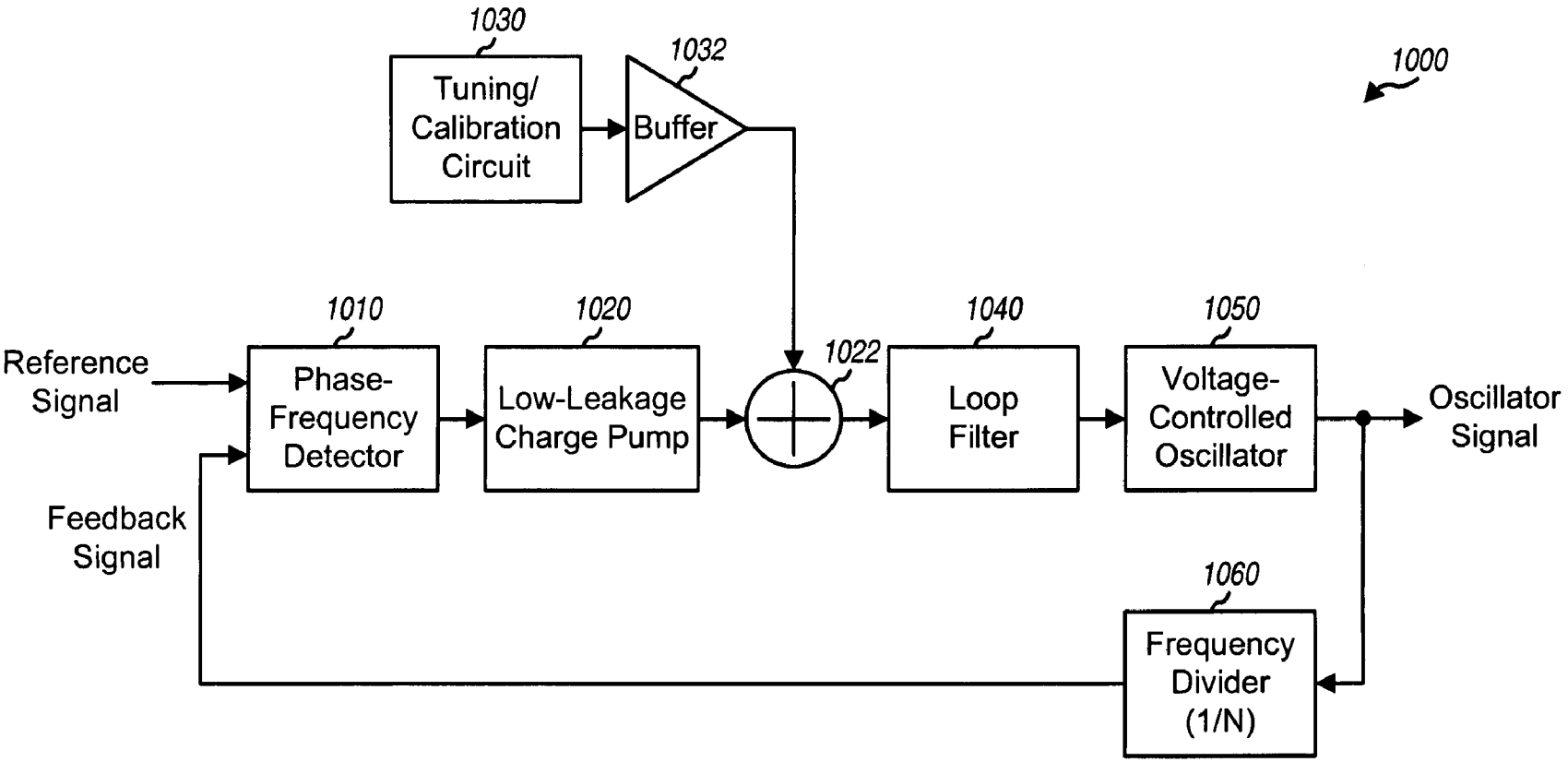
FIG. 10 shows a PLL with low-leakage circuits.

FIG. 10 shows a PLL 1000 suitable for use in various end applications (e.g., wireless communication). A voltage controlled oscillator (VCO) 1050 generates an oscillator signal having a frequency that is determined by a VCO control signal (e.g., a voltage) from a loop filter 1040. A frequency divider 1060 divides the oscillator signal in frequency by a factor of N, where $N \geqq 1$, and provides a feedback signal.

A phase frequency detector 1010 receives a reference signal and the feedback signal, compares the phases of the two signals, and provides a detector signal that indicates the detected phase difference or error between the two signals. For example, detector 1010 may provide Early and Late digital signals that indicate whether the reference signal is early or late with respect to the feedback signal. A low-leakage charge pump 1020 receives the detector signal and generates a current signal that is determined by (and related to) the detected phase difference. Charge pump 1020 may utilize low-leakage current sources and/or low-leakage active circuits to provide low leakage current when disabled.

A tuning/calibration circuit 1030 may provide an adjustment signal (e.g., a voltage) used to tune VCO 1050, calibrate VCO 1050, and so on. This adjustment signal is buffered by a low-leakage buffer 1032 and provided to a summer 1022. Summer 1022 sums the current signal from charge pump 1020 and the buffered signal from buffer 1032 and provides a summed signal to loop filter 1040. Loop filter 1040 filters the signal from summer 1022 and provides the VCO control signal. Summer 1022 may also be placed after (instead of before) loop filter 1040, and the signal from buffer 1032 may be summed with the signal from loop filter 1040 to obtain the VCO control signal.

The VCO control signal controls the frequency of the oscillator signal. Any noise on the VCO control signal translates into phase noise on the oscillator signal. Low-leakage circuits may be used throughout PLL 1000 to reduce noise and error on the VCO control signal. During normal operation, loop filter 1040 may be active and tuning/calibration circuit 1030 and buffer 1032 may be disabled. Loop filter 1040 adjusts the VCO control signal such that the phase of the feedback signal is locked to the phase of the reference signal. Once the PLL is locked to the reference signal, the current signal from charge pump 1020 is typically active for only a small portion of each clock cycle. Charge pump 1020 may be enabled during the time that the current signal may be active and disabled at all other times. This results in low leakage current charging/discharging loop filter 1040 when charge pump 1020 is disabled. During normal operation, buffer 1032 is disabled and presents low leakage current to summer 1022. Low leakage results in less noise since leakage current interferes with the signal from phase frequency detector 1010. During tuning/calibration, circuit 1030 is active and provides the adjustment signal, and low-leakage buffer 1032 provides signal drive for the adjustment signal.

The low-leakage current sources and active circuits described herein may be implemented in various IC process technologies such as C-MOS, N-MOS, P-MOS, bipolar-CMOS (Bi-CMOS), gallium arsenide (GaAs), and so on. CMOS technology can fabricate both N-FET and P-FET devices on the same die, whereas N-MOS and P-MOS technologies can fabricate N-FETs and P-FETs, respectively. The low-leakage current sources and active circuits may also be fabricated with various device size technologies (e.g., 0.13 mm, 90 nm, 30 nm, and so on). The low-leakage current sources and active circuits described herein are more effective and beneficial as IC process technology scales smaller (i.e., to smaller "feature" or device length). The low-leakage current sources and active circuits may also be fabricated on various types of IC such as radio frequency ICs (RFICs), digital ICs, mixed-signal ICs, and so on.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An integrated circuit comprising:

a first transistor operable to provide an output current when enabled and to present a low leakage current when disabled;

a second transistor coupled to a gate and a source of the first transistor and operable to enable or disable the first transistor and further operable to provide a zero or low gate-to-source voltage to disable the first transistor; and a third transistor coupled in series with the first transistor and being disabled to isolate the first transistor from a predetermined voltage when the first transistor is disabled, wherein the first, second, and third transistors are of the same type, either being N-channel field effect transistors or P-channel field effect transistors.

2. The integrated circuit of claim 1, further comprising:

a fourth transistor coupled in a diode configuration and operable to receive a reference current; and a fifth transistor coupled in series with the fourth transistor, wherein the first, third, fourth, and fifth transistors are coupled as a current mirror with the fourth and fifth transistors forming a first path of the current mirror and the first and third transistors forming a second path of the current mirror, and wherein the output current is related to the reference current.

3. The integrated circuit of claim 1, wherein the second transistor is further operable to provide a low impedance path for leakage current of the third transistor when the third transistor is disabled.

4. The integrated circuit of claim 1, wherein the first transistor is operable to provide signal gain.

5. The integrated circuit of claim 1, wherein the first, second, and third transistors are N-channel field effect transistors.

6. The integrated circuit of claim 1, wherein the first, second, and third transistors are P-channel field effect transistors.

7. The integrated circuit of claim 1, wherein the second transistor is enabled or disabled by a control signal and the third transistor is enabled or disabled by a complementary control signal.

8. An integrated circuit comprising:

a first transistor operable to provide an output current when enabled and to present a low leakage current when disabled;

a second transistor coupled to a gate and a source of the first transistor and operable to enable or disable the first transistor and further operable to provide a zero or low gate-to-source voltage to disable the first transistor; and a third transistor coupled in series with the first transistor and being disabled to isolate the first transistor from a predetermined voltage when the first transistor is disabled, wherein the first, second, and third transistors are of the same type, either being N-channel field effect transistors or P-channel field effect transistors, wherein the second transistor is further operable to manipulate a source voltage of the first transistor when the first transistor is disabled.

9. An integrated circuit comprising:

a first transistor operable to provide an output current when enabled and to present a low leakage current when disabled;

a second transistor coupled to a gate and a source of the first transistor and operable to enable or disable the first transistor and further operable to provide a zero or low gate-to-source voltage to disable the first transistor; and a third transistor coupled in series with the first transistor and being disabled to isolate the first transistor from a predetermined voltage when the first transistor is disabled, wherein the first, second, and third transistors are of the same type, either being N-channel field effect transistors or P-channel field effect transistors, wherein the first transistor has a source coupled to the third transistor and a drain providing the output current.

10. An integrated circuit comprising:

a first transistor operable to provide an output current when enabled and to present a low leakage current when disabled;

a second transistor coupled to a gate and a source of the first transistor and operable to enable or disable the first transistor and further operable to provide a zero or low gate-to-source voltage to disable the first transistor; and a third transistor coupled in series with the first transistor and being disabled to isolate the first transistor from a predetermined voltage when the first transistor is disabled, wherein the first, second, and third transistors are of the same type, either being N-channel field effect transistors or P-channel field effect transistors, wherein the second transistor is coupled between a gate of the first transistor and a drain of the third transistor.

11. A device comprising:

a first transistor operable to provide an output current when enabled and to present a low leakage current when disabled;

a second transistor coupled to the first transistor and operable to enable or disable the first transistor; and a third transistor coupled in series with the first transistor and being disabled to isolate the first transistor from a predetermined voltage when the first transistor is disabled, wherein the first, second, and third transistors are of the same type, either being N-channel field effect transistors or P-channel field effect transistors wherein the second transistor is coupled to a gate and a source of the first transistor and is operable to provide a zero or low gate-to-source voltage to disable the first transistor.

12. A device comprising:

a first transistor operable to provide an output current when enabled and to present a low leakage current when disabled;

a second transistor coupled to the first transistor and operable to enable or disable the first transistor; and a third transistor coupled in series with the first transistor and being disabled to isolate the first transistor from a predetermined voltage when the first transistor is disabled, wherein the first, second, and third transistors are of the same type, either being N-channel field effect transistors or P-channel field effect transistors wherein the second transistor is further operable to manipulate a source voltage of the first transistor when the first transistor is disabled.

13. A device comprising:

a first transistor operable to provide an output current when enabled and to present a low leakage current when disabled;

a second transistor coupled to the first transistor and operable to enable or disable the first transistor; and a third transistor coupled in series with the first transistor and being disabled to isolate the first transistor from a predetermined voltage when the first transistor is disabled, wherein the first, second, and third transistors are of the same type, either being N-channel channel field effect transistors or P-channel field effect transistors wherein the first transistor has a source coupled to the third transistor and a drain providing the output current.

14. A device comprising:

a first transistor operable to provide an output current when enabled and to present a low leakage current when disabled;

a second transistor coupled to the first transistor and operable to enable or disable the first transistor; and a third transistor coupled in series with the first transistor and being disabled to isolate the first transistor from a predetermined voltage when the first transistor is disabled, wherein the first, second, and third transistors are of the same type, either being N-channel field effect transistors or P-channel field effect transistors wherein the second transistor is coupled between a gate of the first transistor and a drain of the third transistor.

* * * * *